US008474259B2

(12) United States Patent
Kistner et al.

(10) Patent No.: US 8,474,259 B2
(45) Date of Patent: Jul. 2, 2013

(54) INTERNAL COMBUSTION ENGINE

(75) Inventors: Bruno Kistner, Schömberg (DE); Bernhard Freiermuth, Bellheim (DE); Christoph Müller, Ditzingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 278 days.

(21) Appl. No.: 12/902,601

(22) Filed: Oct. 12, 2010

(65) Prior Publication Data

US 2011/0094225 A1 Apr. 28, 2011

(30) Foreign Application Priority Data

Oct. 28, 2009 (DE) ..... 10 2009 051 848

(51) Int. Cl.

| | |
|---|---|
| ***F02B 33/44*** | (2006.01) |
| ***F02B 39/14*** | (2006.01) |
| ***F01D 25/18*** | (2006.01) |
| ***F01M 1/12*** | (2006.01) |
| ***F01M 9/00*** | (2006.01) |

(52) U.S. Cl.

USPC ..... 60/605.3; 184/6.11; 184/6.13; 184/6.3

(58) Field of Classification Search

USPC ..... 60/605.3; 184/6.11, 6.5, 6.13, 6.3, 184/1.5; 123/572–574

IPC ..... F02B 39/14

See application file for complete search history.

(56) References Cited

U.S. PATENT DOCUMENTS

| | | | | |
|---|---|---|---|---|
| 3,978,671 | A | 9/1976 | Gonzalez | 60/605.3 |
| 4,058,981 | A * | 11/1977 | Henson | 60/605.3 |
| 4,126,997 | A * | 11/1978 | Henson | 60/605.3 |
| 4,142,608 | A * | 3/1979 | Sarle | 184/6.11 |
| 4,599,862 | A * | 7/1986 | Bergeron | 60/605.3 |
| 5,429,101 | A * | 7/1995 | Uebelhoer et al. | 123/572 |
| 6,394,078 | B1 | 5/2002 | Kling | 123/572 |
| 8,109,365 | B2 * | 2/2012 | Taguchi et al. | 184/6.11 |

(Continued)

FOREIGN PATENT DOCUMENTS

| | | |
|---|---|---|
| DE | 43 34 339 | 4/1995 |
| DE | 44 31 088 | 3/1996 |

(Continued)

OTHER PUBLICATIONS

German Search Report, Dated Oct. 13, 2010.

*Primary Examiner* — Thai Ba Trieu

(74) *Attorney, Agent, or Firm* — RatnerPrestia

(57) ABSTRACT

An internal combustion engine includes a crankcase which accommodates cylinders, having at least one exhaust turbocharger and having an oil circuit containing at least one oil pump, in which engine oil is siphoned by at least one oil pump and delivered to the cylinders for lubrication, and in which the or each exhaust turbocharger is coupled to the oil circuit such that siphoned engine oil can be distributed to bearings of the respective turbocharger via an inlet line leading to the respective exhaust turbocharger and can then be expelled from the bearings of the respective exhaust turbocharger in the direction of an oil sump via an outlet line leading away from the respective exhaust turbocharger. The respective outlet line of the respective exhaust turbocharger is assigned a pressure limiting device, with the aid of which a vacuum prevailing at the bearings of the respective exhaust turbocharger can be limited.

7 Claims, 4 Drawing Sheets

U.S. PATENT DOCUMENTS

| | | | | |
|---|---|---|---|---|
| 2002/0095935 | A1 * | 7/2002 | Kapich | 60/599 |
| 2003/0132063 | A1 | 7/2003 | Maier et al. | 184/1.5 |
| 2008/0277201 | A1 | 11/2008 | Taguchi et al. | |

FOREIGN PATENT DOCUMENTS

| | | | |
|---|---|---|---|
| DE | 10 159 104 | | 6/2003 |
| DE | 10 2005 035 731 | | 2/2006 |
| DE | 10 2006 048 504 | | 4/2008 |
| EP | 10 65 350 | | 1/2001 |
| EP | 1788206 | | 5/2007 |
| EP | 19 90 515 | | 11/2008 |
| GB | 2416812 | | 12/2007 |
| JP | 58135325 | | 8/1983 |
| JP | 59190427 | A * | 10/1984 |
| JP | 60040731 | A * | 3/1985 |
| JP | 60060219 | A * | 4/1985 |
| JP | 60138229 | A * | 7/1985 |
| JP | 61123719 | A * | 6/1986 |
| JP | 61135933 | A * | 6/1986 |
| JP | 6257455 | A | 9/1994 |
| JP | 8158876 | A | 6/1996 |

* cited by examiner

INTERNAL COMBUSTION ENGINE

CROSS REFERENCE TO RELATED APPLICATIONS

This U.S. application claims priority to German Application No. DE 10 2009 051848.7, filed on Oct. 28, 2009, which is incorporated by reference herein in its entirety.

FIELD OF THE INVENTION

The invention relates to an internal combustion engine.

BACKGROUND OF THE INVENTION

FIG. 1 shows a schematized block diagram of an internal combustion engine 10 known from the prior art, the internal combustion engine 10 known in practice comprising a crankcase 11, which accommodates cylinders (not shown in detail) of the internal combustion engine 10. The cylinders of the internal combustion engine 10 form two cylinder groups 12, 13, and there is a cylinder head housing 14 and 15, respectively, for each cylinder group 12, 13. Interacting with each cylinder group 12, 13 of the internal combustion engine 10 there is an exhaust turbocharger 16 and 17, respectively, and of the two exhaust turbochargers 16 and 17 the figure shows a turbine 18 and 19, respectively, for expansion of an exhaust gas flow from the internal combustion engine and a compressor 20 and 21, respectively, for compression of a combustion air flow to be fed to the cylinders of the internal combustion engine. The combustion air compressed by the compressors 20, 21 of the exhaust turbochargers 16, 17 can be fed to the cylinders or cylinder groups 12 and 13, respectively, of the internal combustion engine 10 via a throttle valve 22 and a so-called pressure system 23.

As can be seen from FIG. 1, combustion air which is to be compressed in the compressors 20 and 21 of the exhaust turbochargers 16 and 17, respectively, is passed via an air filter 24 and 25, respectively, before being fed to the respective compressor 20 and 21, a measuring device 26 and 27, respectively, for the metrological detection of the air quantity fed to the respective compressor 20 and 21 is inserted between the air filters 24 and 25 and the compressors 20 and 21 of the exhaust turbochargers 16 and 17, respectively.

The internal combustion engine 10 known from the prior art and shown in schematic form by means of a block diagram in FIG. 1 furthermore has an open oil circuit with an oil pump 28, only the suction stage of the oil pump 28 being shown, it being possible to use the illustrated suction stage of the oil pump 28 to suck in engine oil and pump it in the direction of the cylinder groups 12 and 13 and hence in the direction of the cylinder head housings 14 and 15, respectively, in order to lubricate the cylinders of the two cylinder groups 12 and 13.

According to FIG. 1, the exhaust turbochargers 16, 17 are coupled to the open oil circuit of the internal combustion engine 10 in such a way that engine oil can be fed to each exhaust turbocharger 16 and 17, respectively, via an inlet line 29 and 30, respectively, from the respective cylinder head housings 14 and 15 in order to lubricate bearings of the respective exhaust turbochargers 16 and 17, after which the engine oil is sucked in the direction of an oil sump 35, namely by the suction stage of the oil pump 28, from the bearings of the respective exhaust turbochargers 16 and 17 via an outlet line 31 and 32, respectively.

The oil pump 28 used or the suction stage thereof is an unregulated constant delivery pump, which has a constant displacement for each revolution. Since the oil pump 28 is driven in a manner dependent on the speed of the internal combustion engine, the oil volume sucked in by the suction stage of the oil pump 28 increases as the speed of the internal combustion engine increases, and, as a result, an increasing vacuum is formed in the region of the bearings of the exhaust turbochargers 16 and 17 as the speed increases. When the vacuum in the region of the bearings of the exhaust turbochargers 16 and 17 becomes too great, the exhaust turbochargers 16 and 17, respectively, can be damaged. Moreover, an excessive vacuum could lead to a malfunction of the exhaust turbocharger.

In order to counteract this problem, there are bypass lines 33 and 34 in the internal combustion engine 10 known from the prior art and shown in FIG. 1, said bypass lines bringing about pressure equalization between the pressure level in the crankcase 11 or cylinder head housings 14 and 15 and the pressure level in the bearings of the exhaust turbochargers 16 and 17. However, these bypass lines 33 and 34 make the structure of an internal combustion engine relatively complex.

Taking this situation as a starting point, it is the underlying object of the present invention to provide a novel internal combustion engine which is of simpler construction.

SUMMARY OF THE INVENTION

According to aspects of the invention, the respective outlet line of the respective exhaust turbocharger is assigned a pressure limiting device, with the aid of which a vacuum prevailing at the bearings of the respective exhaust turbocharger can be limited. In particular, the pressure limiting device according to aspects of the invention can be used to adjust or adapt the vacuum prevailing at the bearings of the respective exhaust turbocharger as a function of the particular operating point of the internal combustion engine.

In the internal combustion engine according to aspects of the invention, it is possible to dispense with the bypass lines required in the prior art. With the aid of the pressure limiting device assigned to the respective exhaust line of the respective exhaust turbocharger, the vacuum prevailing at the bearings of the respective exhaust turbocharger can be limited, and there is therefore no danger that the exhaust turbochargers will be damaged as a result of an excessive vacuum. Since it is possible to dispense with bypass lines, the structure of the internal combustion engine is simplified.

According to a first advantageous development of the invention, the pressure limiting device and the oil pump are designed as discrete subassemblies and are each assigned as separate subassemblies to the respective outlet line. When the pressure limiting device and the oil pump are designed as discrete subassemblies and are assigned as discrete subassemblies to the respective outlet line of the respective exhaust turbocharger, the subassembly can be replaced individually if a fault occurs in one of these subassemblies.

According to a second, alternative, advantageous development of the invention, the pressure limiting device is integrated into the oil pump and assigned together with the latter to the respective outlet line. Integrating the pressure limiting device into the oil pump makes it possible to reduce the required installation space.

BRIEF DESCRIPTION OF THE DRAWINGS

Preferred developments of the invention will be found in the subclaims and the following description. An illustrative embodiment of the invention will be explained in detail with reference to the drawing, although the invention is not limited thereto. In the drawing:

DETAILED DESCRIPTION OF THE PREFERRED EMBODIMENTS

Figure 1:
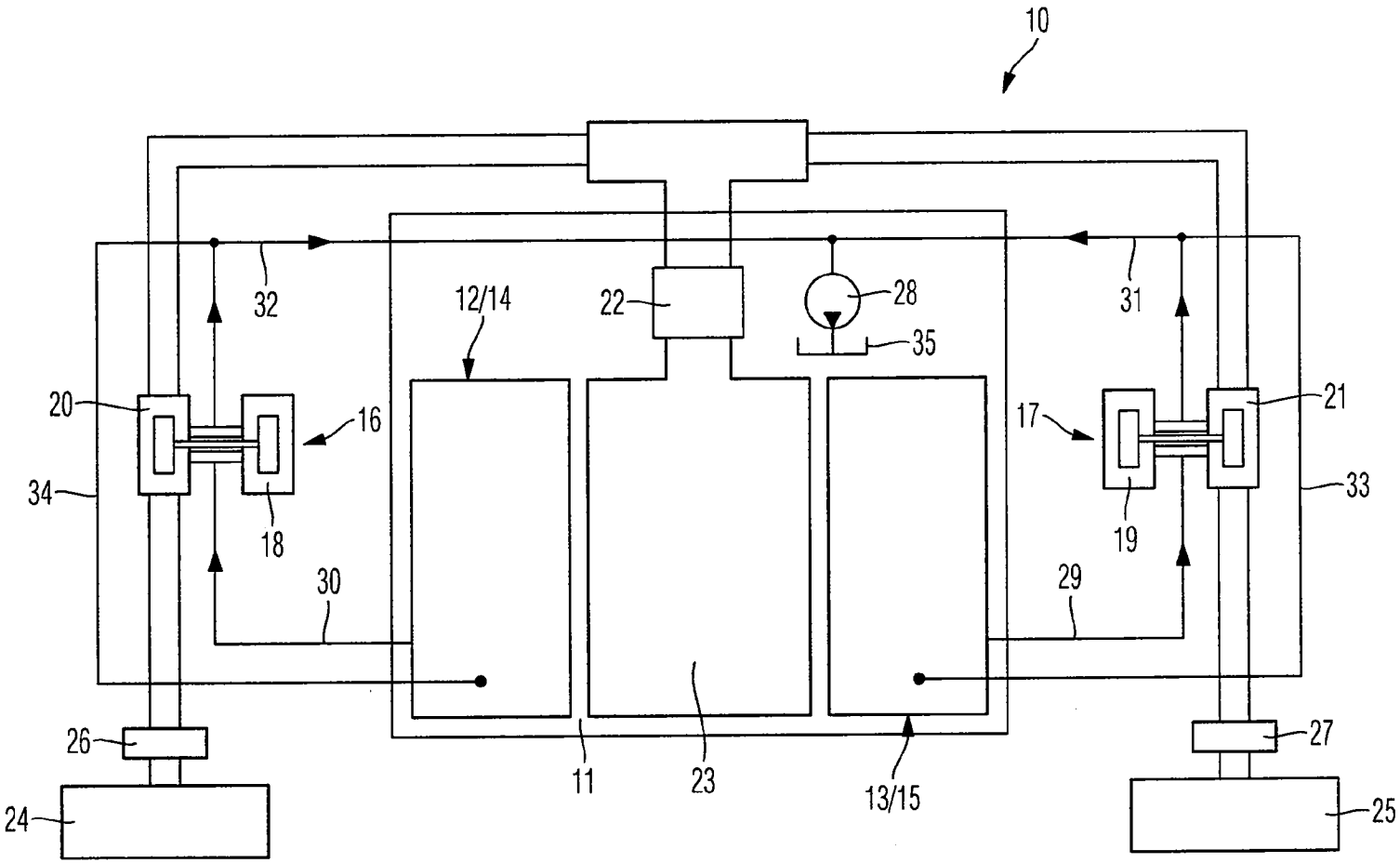
Fig. 1 (PRIOR ART)
FIG. 1: shows a block diagram of an internal combustion engine known from the prior art.
Figure 2:
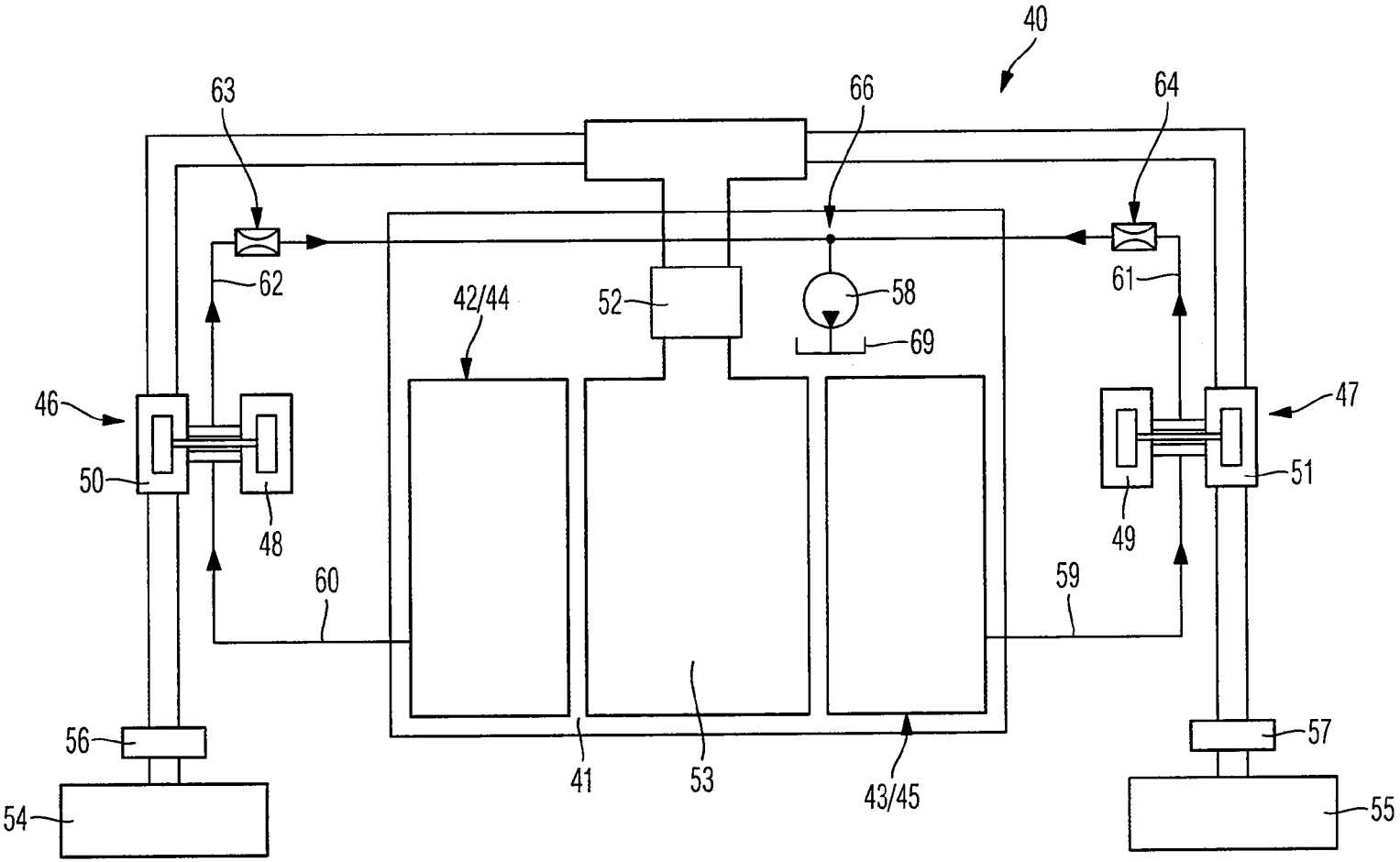
FIG. 2: shows a block diagram of an internal combustion engine according to aspects of the invention in accordance with a first illustrative embodiment of the invention.

FIG. 2 shows a highly schematized block diagram of a preferred illustrative embodiment of an internal combustion engine 40 according to aspects of the invention, which is again used to accommodate cylinders (not shown in detail) by means of a crankcase 41. FIG. 2 again shows just two cylinder groups 42 and 43 with the corresponding cylinder head housings 44 and 45 of the cylinder groups 42 and 43.

Interacting with each cylinder group 42 and 43 there is again an exhaust turbocharger 46 and 47, respectively, and of the exhaust turbochargers 46 and 47 the figure again shows the turbines 48 and 49 and the compressors 50 and 51. The turbines 48 and 49 are used for expansion of an exhaust gas flow from the internal combustion engine, namely an exhaust gas flow from the respective cylinder groups 42 and 43, the turbines 48 and 49 of the exhaust turbochargers 46 and 47 driving the respective compressors 50 and 51 of the respective turbochargers 46 and 47 in order to compress a combustion air flow to be fed to the internal combustion engine. The compressed combustion air flow again passes via a throttle valve 52 and a pressure system 53 into the regions of the respective cylinder groups 42 and 43.

In the case of the internal combustion engine 40 in FIG. 2, too, combustion air to be compressed in the compressors 50, 51 of the exhaust turbochargers 46, 47 is passed via air filters 54 and 55, respectively, before being fed to the compressors 50, 51, and once again there are measuring devices 56, 57 positioned between the air filters 54 and 55 and the compressors 50 and 51 of the exhaust turbochargers 46, 47, respectively, in order to detect metrologically, e.g. by means of a Motronic pressure system, the air quantity fed to the compressors 50, 51.

The internal combustion engine 40 according to aspects of the invention in FIG. 2 again has an open oil circuit with an oil pump 58, of which once again only a suction stage is shown. The oil pump 58 or suction stage thereof is designed as an unregulated constant delivery pump driven as a function of the engine speed. Thus, the oil pump 58 or suction stage thereof has a constant displacement for each pump revolution.

By means of the oil pump 58 or suction stage thereof, engine oil can be sucked in in the direction of an oil sump 69 and pumped in the direction of the cylinder groups 42 and 43 in order to lubricate the cylinders of the internal combustion engine 40.

Once again, the exhaust turbochargers 46 and 47 are coupled to the open oil circuit of the internal combustion engine in such a way that engine oil can be fed to the exhaust turbochargers 46 and 47 via inlet lines 59 and 60, respectively, in order to lubricate bearings of the exhaust turbochargers 46 and 47, respectively, and, from the bearings of the exhaust turbochargers 46 and 47, the engine oil can be carried or sucked off in the direction of the oil sump 69 via outlet lines 61 and 62, respectively, with the aid of the suction stage of the oil pump 58.

In order to counteract an increase in the vacuum in the region of the bearings of the turbochargers 46 and 47 with the increasing speed of the internal combustion engine 40 and hence the increasing speed of the suction stage of the oil pump 58, each outlet line 62 and 61 of the respective turbocharger 46 and 47 in the illustrative embodiment shown in FIG. 2 is assigned a pressure limiting device 63 and 64, respectively, with the aid of which the vacuum prevailing at the bearings of the respective exhaust turbocharger 46 and 47 can be limited. According to FIG. 2, the pressure limiting devices 63 and 64 are designed as restrictors.

Figure 3:
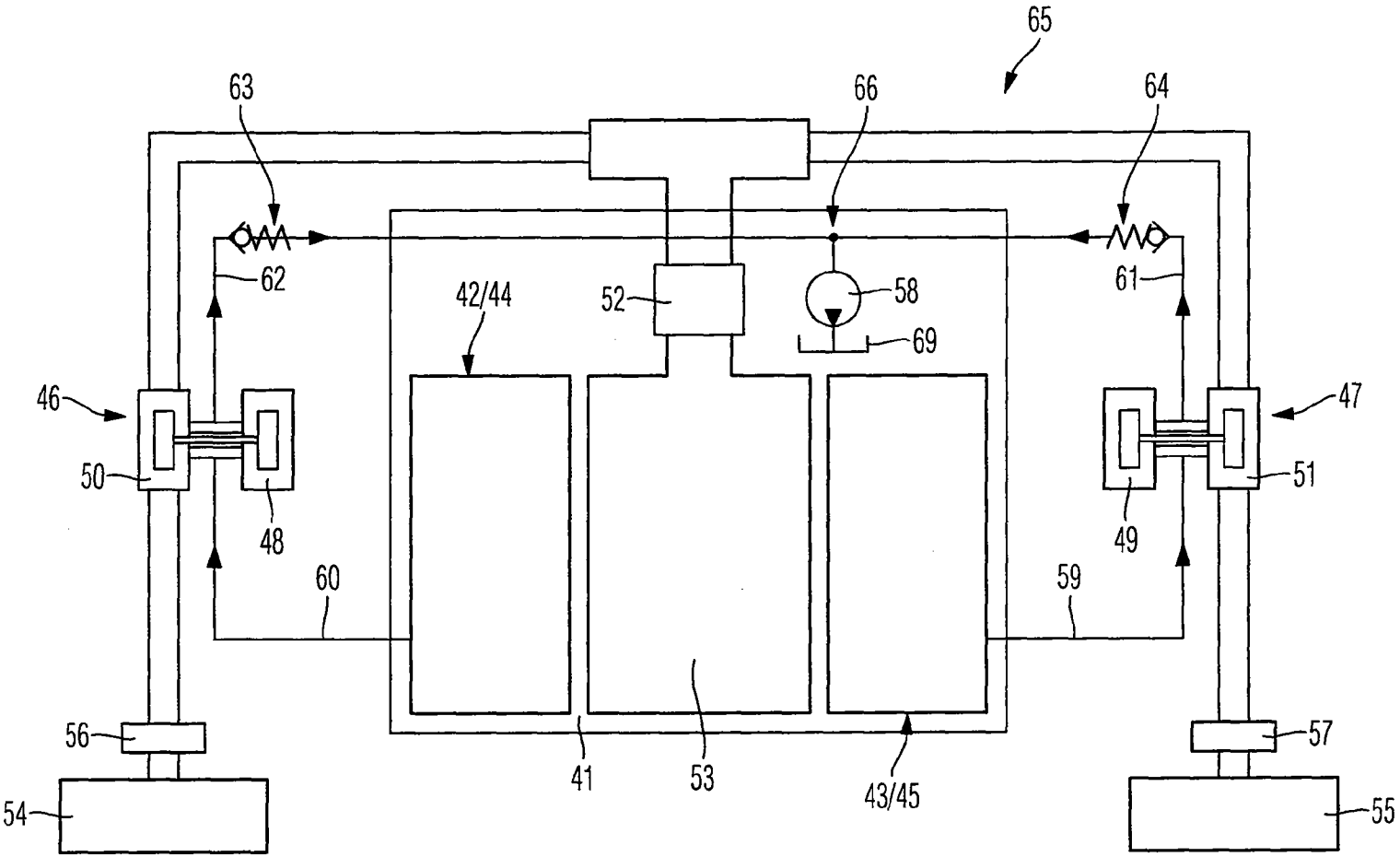
FIG. 3: shows a block diagram of an internal combustion engine according to aspects of the invention in accordance with a second illustrative embodiment of the invention.

FIG. 3 shows another illustrative embodiment of an internal combustion engine 65 according to aspects of the invention, which corresponds substantially to the illustrative embodiment in FIG. 2, for which reason identical reference signs are used for identical subassemblies to avoid unnecessary repetition. The internal combustion engine 65 in FIG. 3 differs from the internal combustion engine 40 in FIG. 2 only as regards the design of the pressure limiting devices 63 and 64 assigned to the outlet lines 62 and 61, the pressure limiting devices 63 and 64 in the illustrative embodiment in FIG. 3 being embodied as check valves.

In the illustrative embodiments in FIGS. 2 and 3, the outlet lines 61 and 62 are coupled to one another or merge into one another, and the common oil pump 58 or suction stage thereof is positioned downstream of a coupling point 66 or connecting point of the two outlet lines 62 and 61, as seen in the direction of flow of the engine oil. The pressure limiting devices 63 and 64 are each positioned upstream of the coupling point 66 of the outlet lines 62 and 61, between the respective exhaust turbochargers 46 and 47 or bearings thereof and the common oil pump 58 or suction stage thereof, as seen in the direction of flow of the engine oil.

As a departure from this, it is also possible for the two outlet lines 61 and 62 not to be coupled to one another but instead to be constructed independently or separately from one another. In this case, each outlet line is preferably assigned a discrete, independent oil pump or suction stage.

In the illustrative embodiments in FIGS. 2 and 3, the pressure limiting devices 63 and 64 and the common oil pump 58 or suction stage thereof are each embodied as discrete or separate subassemblies.

Figure 4:
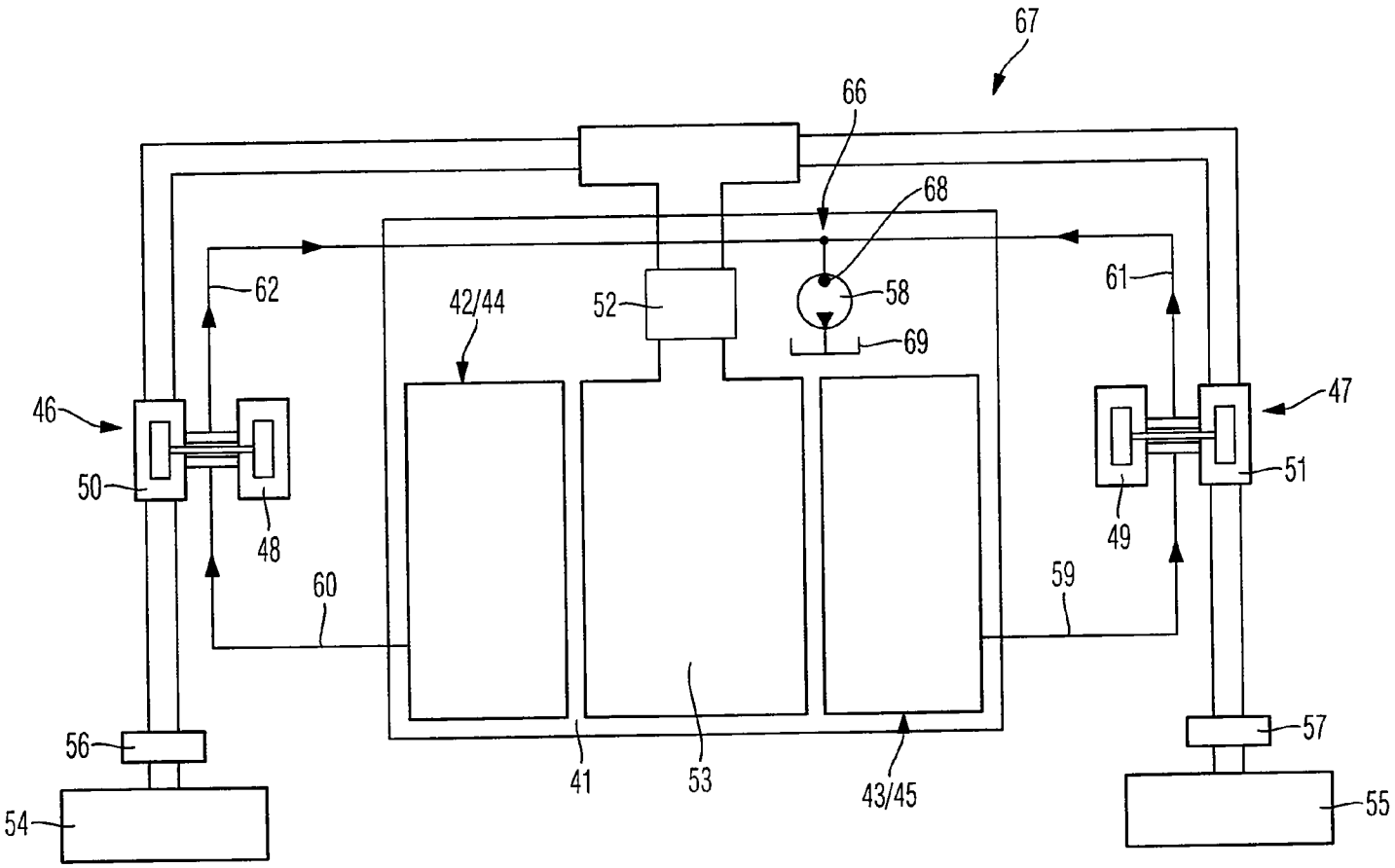
FIG. 4: shows a block diagram of an internal combustion engine according to aspects of the invention in accordance with a third illustrative embodiment of the invention.

FIG. 4, in contrast, shows another illustrative embodiment of an internal combustion engine 67 according to aspects of the invention, in which a common pressure limiting device 68 is integrated into the common oil pump 58 or suction stage for both exhaust turbochargers 46 and 47. In this case, there is accordingly a common pressure limiting device 68 for the two exhaust turbochargers 46 and 47, said device being integrated into the common oil pump 58 or suction stage thereof. It is thereby possible to reduce the required installation space to an absolute minimum.

As regards the remaining details, the illustrative embodiment in FIG. 4 corresponds to the illustrative embodiments in FIGS. 2 and 3, for which reason identical reference signs are once again used for identical subassemblies to avoid unnecessary repetition.

With reference to FIGS. 2 to 4, the invention has been described using an internal combustion engine with two turbochargers as an example. Of course, the invention can also be employed where the internal combustion engine has just one single turbocharger.

LIST OF REFERENCE SIGNS

10 internal combustion engine
11 crankcase
12 cylinder group
13 cylinder group
14 cylinder head housing
15 cylinder head housing
16 exhaust turbocharger
17 exhaust turbocharger
18 turbine
19 turbine
20 compressor
21 compressor
22 throttle valve
23 pressure system
24 air filter
25 air filter
26 measuring device
27 measuring device
28 oil pump
29 inlet line
30 inlet line
31 outlet line
32 outlet line
33 bypass line
34 bypass line
35 oil sump
40 internal combustion engine
41 crankcase
42 cylinder group
43 cylinder group
44 cylinder head housing
45 cylinder head housing
46 exhaust turbocharger
47 exhaust turbocharger
48 turbine
49 turbine
50 compressor
51 compressor
52 throttle valve
53 pressure system
54 air filter
55 air filter
56 measuring device
57 measuring device
58 oil pump
59 inlet line
60 inlet line
61 outlet line
62 outlet line
63 pressure limiting device
64 pressure limiting device
65 internal combustion engine
66 coupling point
67 internal combustion engine
68 pressure limiting device
69 oil sump

The invention claimed is:

1. An internal combustion engine comprising:

a crankcase which accommodates cylinders, an oil circuit containing at least one oil pump, in which engine oil is siphoned by the at least one oil pump and delivered to the cylinders for lubrication, exhaust turbochargers that are each coupled to the oil circuit in such a way that siphoned engine oil is configured to be delivered to bearings of the respective exhaust turbocharger via an inlet line leading to the respective exhaust turbocharger and is then expelled from the bearings of the respective exhaust turbocharger in a direction of an oil sump via an outlet line leading away from the respective exhaust turbocharger, wherein the outlet lines of the respective exhaust turbochargers are coupled to each other at a coupling point of the outlet lines and form a combined outlet line, wherein the at least one oil pump is connected to the combined outlet line downstream of the coupling point of the outlet lines in a direction of flow of the engine oil, wherein each of the outlet lines includes a pressure limiting device upstream of the coupling point of the outlet lines in the direction of flow of the engine oil, and wherein the pressure limiting device respective to each of the outlet lines limits a vacuum prevailing at the bearings of the respective exhaust turbocharger.

2. The internal combustion engine according to claim 1, wherein each pressure limiting device is a restrictor.

3. The internal combustion engine according to claim 1, wherein each pressure limiting device is a valve.

4. The internal combustion engine according to claim 1, wherein each pressure limiting device is a check valve.

5. The internal combustion engine as claimed in claim 1, said pressure limiting devices being discrete subassemblies in relation to the common oil pump or suction stage.

6. The internal combustion engine as claimed in claim 1, wherein the combined outlet lines are assigned a common pressure limiting device, which is integrated into the common oil pump or suction stage.

7. The internal combustion engine as claimed in claim 1, wherein the combined outlet lines are assigned a common pressure limiting device, which is a discrete subassembly in relation to the common oil pump or suction stage.

* * * * *